United States Patent [19]

Aue

[11] 3,988,788

[45] Nov. 2, 1976

[54] DEVICE FOR CLEANING A TOILET

[76] Inventor: Karl Aue, Leonhardplatz 2, 808 Furstenfeldbruck, Germany

[22] Filed: Dec. 29, 1975

[21] Appl. No.: 645,240

[52] U.S. Cl. ..... 4/233

[51] Int. Cl.[2] ..... A47K 13/00; A47K 13/30; A47K 17/00

[58] Field of Search ..... 4/233, 1, 229, 222, 4/237, 242; 15/215, 256.5

[56] References Cited

UNITED STATES PATENTS

| | | | |
|---|---|---|---|
| 2,605,478 | 8/1952 | Lassiter | 4/233 |
| 2,798,142 | 7/1957 | Mancin | 4/233 |
| 3,599,246 | 8/1971 | Bramati | 4/233 |
| 3,815,158 | 6/1974 | Schnyder et al. | 4/1 X |
| 3,837,018 | 9/1974 | Haberle | 4/233 |

FOREIGN PATENTS OR APPLICATIONS

| | | | |
|---|---|---|---|
| 455,897 | 2/1928 | Germany | 4/233 |

*Primary Examiner*—Henry K. Artis

[57] ABSTRACT

A device is provided for cleaning a water-flushed toilet bowl and toilet seat. The cleaning device is characterized by spray means secured to the toilet seat lid means, for dispersment of a cleansing fluid and drying means secured to the underside of said lid means and positioned above the bowl for dispersment of a drying agent. The cleaning device is further characterized by the addition of guide means for guide the respective fluid (cleaning fluid or drying agent) onto the toilet seat for drying thereof or cleansing thereof.

22 Claims, 7 Drawing Figures

DEVICE FOR CLEANING A TOILET

Figure 1:
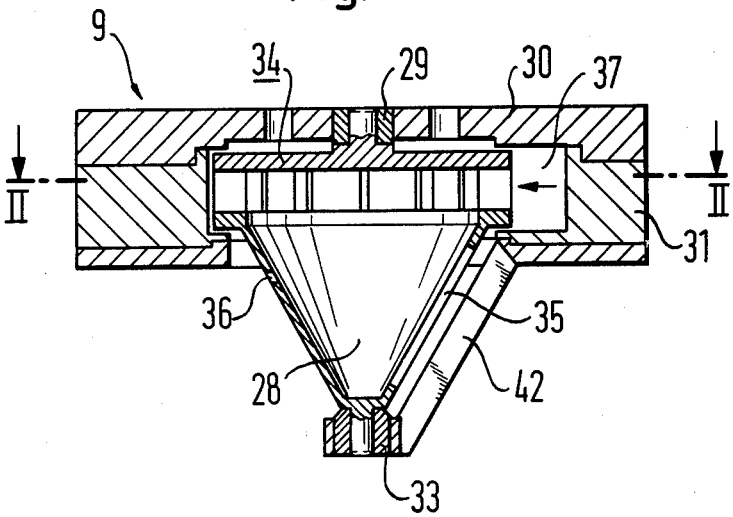

This invention relates to a device for cleaning a toilet with a water-flushed bowl, at least one spray means being provided in the area of the interior and the upper edge of the bowl, from which a cleaning fluid is sprayed.

It is a well-known fact that flushing a toilet with water, as is commonly the case, is not always sufficient to empty a toilet bowl after use so that it is absolutely free of residue. Moreover, there is considerable danger of infection in toilets in hotels, hospitals, offices, industrial plants etc. if the seal surface is not cleaned carefully after every use.

It is known from German patent specification 207,221 to mount on the toilet cover a spray means from which the interior of the bowl can be sprayed with water in addition to the normal water flushing of the toilet.

In addition, U.S. patent specification 2,605,478 makes it known to install the entire toilet in a container whose upper part, which must be tipped up for use, contains a shower for spraying the toilet externally and internally.

These known means, however, have not proved to be satisfactory in practice, since either the cleaning effect thereof is not adequate or the construction of the means is too complicated.

It is therefore the object of the present invention to provide a device for cleaning the bowl and the seat of a toilet which has an extraordinarily simple structure and which ensures particularly intensive cleaning of the bowl and seat as well as effective drying of the seat surface.

Another object in accordance with the invention is that the device should be regulated such that the cleaning device is activated without contact so that the user does not have to touch any operating elements.

The objects according to the invention are accomplished by the features set forth in the patent claims.

According to the invention, the conventional toilet seat, which is generally mounted pivotally on the bowl, may be omitted entirely by designing the upper rim of the bowl to be a seat surface and by providing it with a suitable covering if desired.

After the spray means has been deactivated, the ventilator, in operation at the same time as the spray means, dries the seat surface. The drying operation may be promoted by a slight vaulting of the seat surface so that the cleaning fluid runs off well by itself which in turn can be accelerated by using a cleaning fluid with low surface tension. In order to expedite the drying operation, a heating means may also be provided to dry the seat surface with heated air.

The device in accordance with the invention contributes decisively in particular in combating the transmission of infective diseases and in preventing the development of skin irritations, rashes and allergies.

Figure 2:
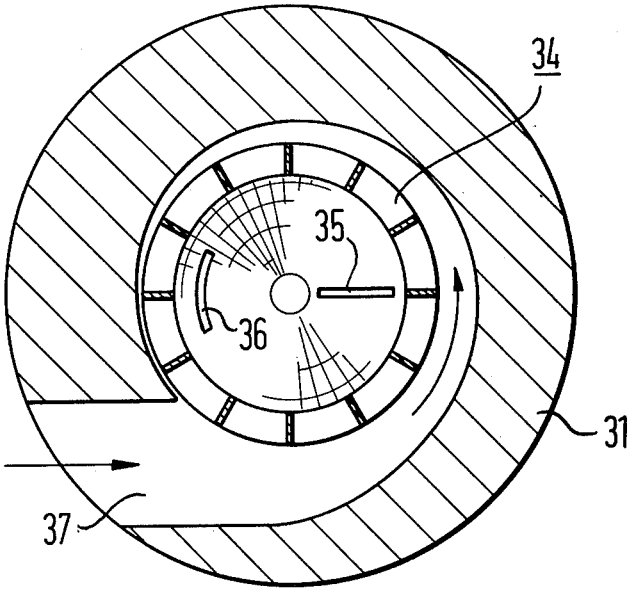
Figure 3:
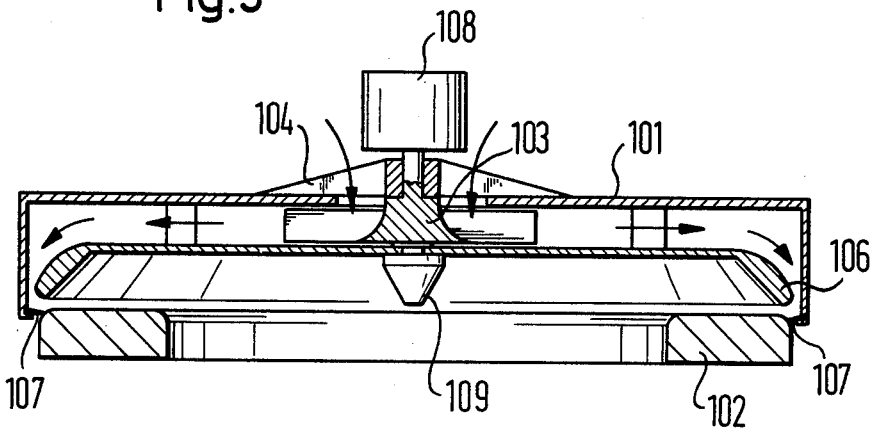
Figure 4:
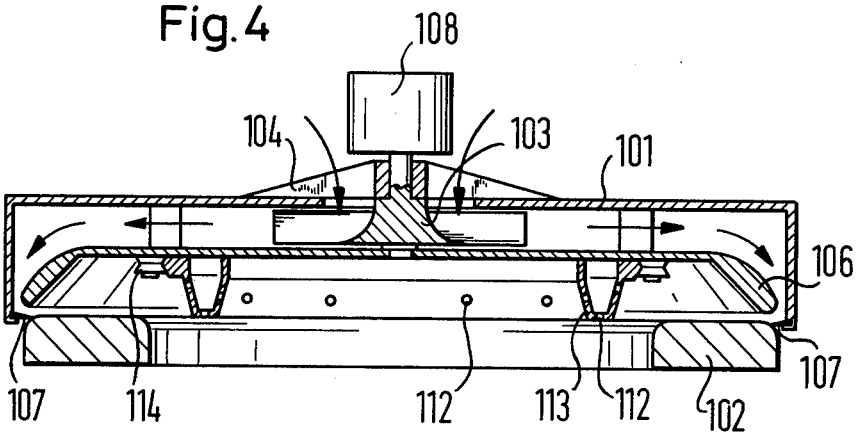
Figure 5:
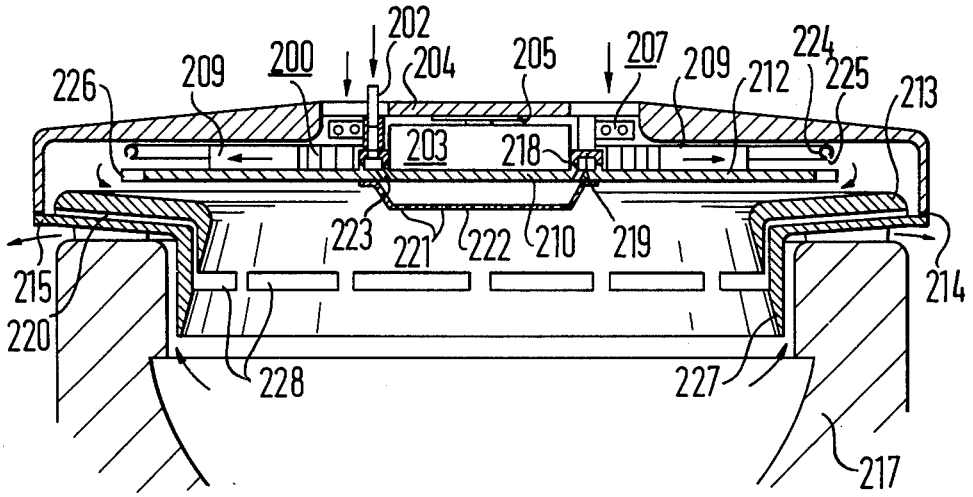
Figure 7:
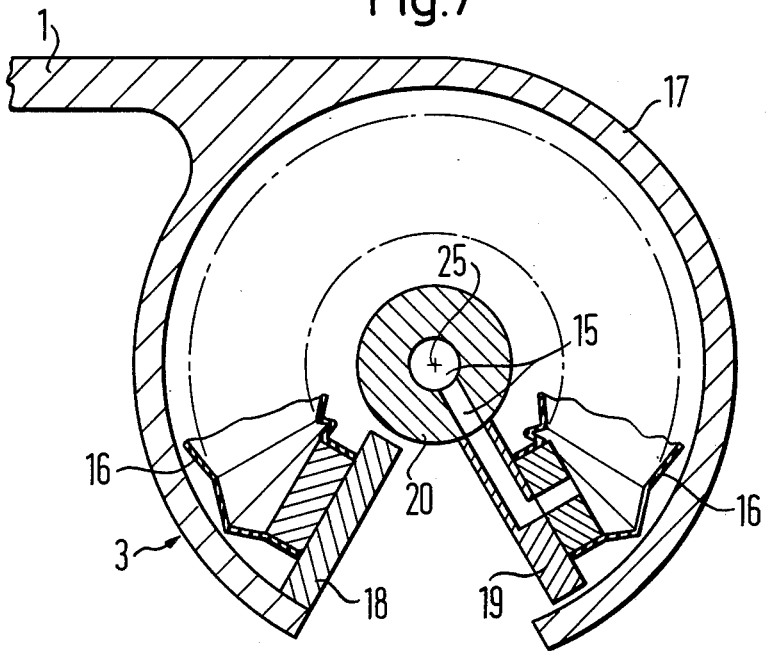
Figure 6:
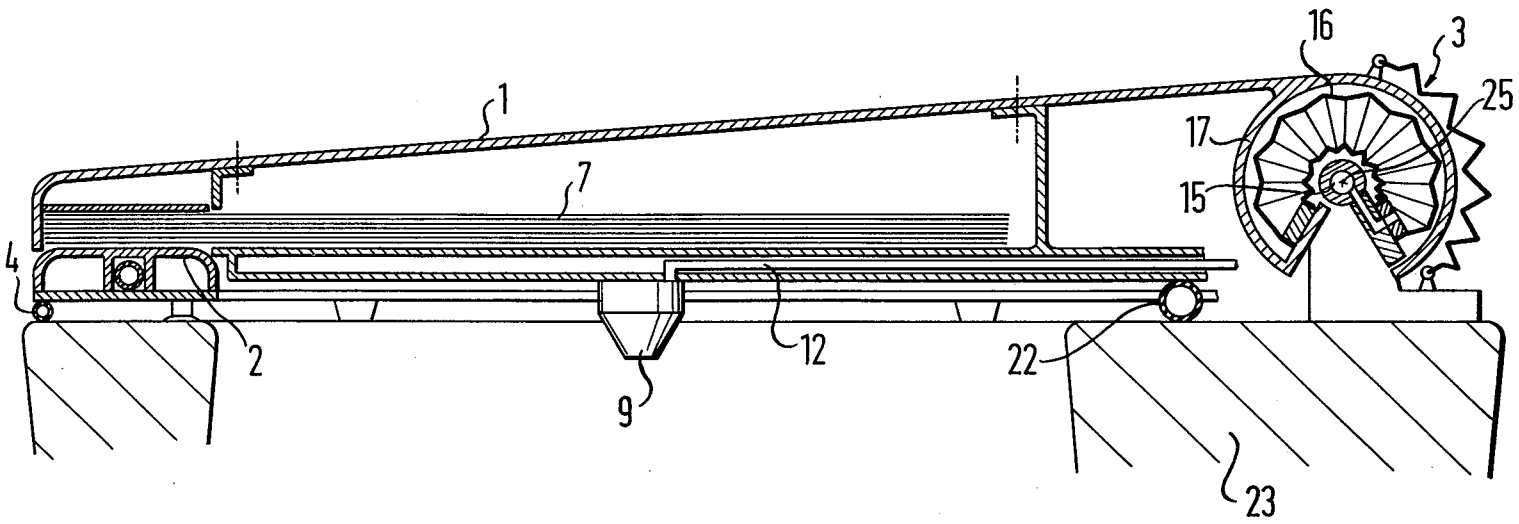

The invention will now be described in more detail in the following with reference to the drawing in which:

FIG. 1 is a vertical section through a washing head,

FIG. 2 is a horizontal section through the washing head illustrated in FIG. 1 along the line II—II, FIG. 3 is a vertical section through a device in accordance with the invention, FIG. 4 is a vertical section through another embodiment of the device in accordance with the invention, FIG. 5 is a vertical section through another embodiment of the device in accordance with the invention, FIG. 6 is yet another vertical section revealing the arrangement of the washing head as well as the position of the inventive drive means for opening and closing the cover, and FIG. 7 is a section through the drive means for opening and closing the cover.

A longitudinal section through an inventive spray head 9 is illustrated in FIG. 1 of the drawing. An upper housing part 30 and a lower housing part 31 enclose an interior in which an impeller wheel 34 is disposed. Moreover, an inlet 37 is provided in the housing for a cleaning fluid and tapers in the direction of flow according to FIG. 2 as indicated by the arrow shown in FIG. 2. A chamber 28 with a conical shape is connected to the impeller wheel 34 at the bottom which is designed as a turbine rotor according to FIG. 1. The assembly formed from the impeller wheel 34 and the chamber 28 has a journal both on the side of the impeller wheel 34 as well as on the opposite side. The two journals are rotatably supported in a bearing sleeve 29 adjacent the housing on the one side and in a bearing sleeve 33 on the side of the cone. The bearing sleeve 33 is supported by a narrow bar 42 which is supported on the lower housing part 31. The chamber 28 has a slot-shaped water discharge opening 35 extending along a generatrix of the cone. On the side opposite the water discharge opening 35, another water discharge opening 36 is provided which is disposed in a plane extending perpendicularly to the axis of rotation and which is also slot-shaped.

A cleaning fluid (water) is supplied through the inlet 37 to operate the spray head 9. A disinfecting agent may be added to this cleaning fluid as well.

Since the inlet 37 tapers, the flow rate increases so that cleaning fluid is ejected under a high pressure from the two discharge openings 35 and 36 while the chamber 28 rotates. A type or kind of fluid curtain is ejected from the discharge opening 36 which primarily cleans a specific height of the bowl 23.

A kind of fluid curtain is ejected from the discharge opening 35 which is disposed substantially vertically and which covers practically the entire inner surface of the bowl 23 during corresponding rotation of the chamber 28 (cf. FIG. 6).

The discharge openings 35 and 36 may of course be adapted slightly to the shape of a particular bowl 23 and may also serve to clean the seat surface.

According to FIG. 3 a washing head 109 is mounted in the central area of the guide plate 106 which is designed substantially as a level plate and expediently has its downwardly bent outer edge extend to the area of the outer rim of the toilet seat 102. When the cover 101 to which the guide plate 106 is attached is lowered, an annular gap remains between the guide plate 106 and the seat 102. The outer edge of the seat 102 and the outer lower edge of the cover 101 are sealed relative to one another, for example by an annular seal 107. A ventilator 103 driven by a motor 108 is located in the central area of the cover. Radially disposed vanes 104 serve to mount the motor and to reinforce the structure.

After the fluid supply has been discontinued, air is blown into the space between the cover 101 and the guide plate 106 in an outwardly radial manner by the ventilator 103 which is driven by the drive motor 108. According to a preferred embodiment, the air inlet for the air sucked in by the ventilator 103 is positioned in the rear part of the seat or the bowl at a protected site. The direction of air flow is indicated by arrows. The air flows about the outer edge of the guide plate 106, passes through the annular gap between the guide plate 106 and the cover 101 as well as through the annular gap formed between the seal 102 and the guide plate 106, and then flows over the seat 102. The surface of the seat 102 is vaulted slightly to facilitate the runoff of the cleaning fluid.

According to FIG. 4 a spray ring 113, which is rotatable in the spray ring bearing 114, is attached to the bottom of the guide plate 106. The spray ring includes nozzle openings 112 so that it is set in rotational motion by the kickback of the cleaning agent. Some of the nozzle openings 112 spray the interior of the bowl while others are mounted on the outer periphery of the ring in order to spray the seat.

According to FIG. 5 a spray means 222 is attached to the guide plate 212 in the central area thereof. A space in which cleaning fluid can collect remains between the outer edge of the seat 213 and the outer edge of the cover 204. Attached to the outer periphery of the seat 213 is a radial cover abutment flange 215 upon which the outer edge of the closed cover 204 rests via a cover seal 214. Drain slots 220 serving as drains for the cleaning fluid from the area of the outer periphery of the seat 213 lead radially to the inner side of a skirt 227 comprising return slots 228, said skirt projecting into the bowl 217. The drain slots 220 as well as the return slots 228 may be worked into the bowl, particularly when the seat also constitutes an integral component part of the bowl.

A ventilator 200 with blades 209 is accommodated in the central area of the cover 204 and is driven together with the spray means 222 by a motor 203 which is attached to the bottom of the cover by means of an assembly plate 205. The motor may also be mounted at another site such as on the rear side of the toilet and the drive may be transmitted via a belt or the like.

In an alternative embodiment, the ventilator 200 may be driven together with the spray means 222 by the pressure of the fluid similar to the spray head in accordance with FIGS. 1 and 2. In this embodiment the cleaning fluid, which still serves to drive the ventilator 200 even after termination of the washing operation, is drained in a manner such that it does not impinge any longer on the seat surface.

In order to accelerate the drying operation and/or to heat the seat 213, a heating means 207 is provided to heat the drying air.

An inlet opening for the cleaning fluid is illustrated at 202 in FIG. 5 which is supplied to the spray means 222 via bores 223. A sealing ring 218 seals the stationary central part 219 of the cover 204 relative to the rotating central part 210 of the guide plate 212 so that no contact is established.

The embodiment of the subject matter of the invention illustrated in FIG. 5 operates in the following manner:

After the toilet has been used, the cover 204 is closed through a control means without contact. The inlet opening 202 is connected with a source of cleaning fluid supply (water line) thereafter via a valve (not shown). The cleaning fluid then passes through the inlet opening 202 and through bores 223 to the rotating discharge openings 221. In so doing, the bowl and seat 213 are cleaned. The cleaning fluid which spills over the outer edge of the seal 213 is returned to the bowl 217 via drain slots 220 which may also be provided within the body of the bowl.

The supply of cleaning fluid is thereafter discontinued, whereupon the seat is dried by the air which has been pressed outwardly in a radial direction by the ventilator 200.

According to FIG. 5 the guide plate 212 has a piece which rotates together with the ventilator 200 and the spray means 222. Blades 226 are attached to said piece which divert the air which the ventilator 200 conducts outwardly in a radial fashion onto the surface of the seat 213, thereby causing a greater amount of the drying air to flow about the seat and thus accelerating the drying operation.

In FIG. 5 a washing fluid supply line 224 is also provided whose terminations or outlets are distributed on the periphery above the blades 226 so as to release washing fluid at this location which then is accelerated by the blades 226 such that it impinges on the surface of the seat 213 under especially high pressure.

According to FIG. 6 a seat 2 is located above the edge of a toilet bowl illustrated by the hatching and is sealed with respect to the upper edge of the toilet bowl by a seal 4. The seat 2 may also be rigidly mounted on the bowl or form an integral piece with the bowl.

A toilet cover 1 is disposed above the seat 2, is designed as a storage container for protective seat covers 7, is open at the bottom and is sealed with respect to the upper edge of the toilet bowl by a seal 22.

A washing head 9 may be mounted on the underside of the toilet cover 1 and is supplied with water or another cleaning fluid through a water supply line 12.

A drive means 3 for the cover 1 is disposed adjacent the pivot bearing shaft 25. The bellows 16 serves to move the cover from the opened to the closed position with a pressurized fluid from the supply line 15. The toilet cover 1 is moved from the closed to the open position by means of the return spring 14, or an auxiliary drive means such as 3 may also be used alternatively to open the toilet cover.

A hollow shaft 20 to which a radially outwardly extending corrugated plate 19 is attached is disposed adjacent the pivot bearing shaft 25. This corrugated plate extends to the inner wall of a cylindrical housing 17 to which a housing plate 18 is attached which projects inwardly in a radial manner from the inner wall of the housing 17 and extends to the outer periphery of the hollow shaft 20. According to FIG. 7 a bellows 16 is disposed between the corrugated plate 19 and the housing plate 18 and is secured sealingly on the front sides to the two plates 19 and 18 respectively. The interior of the hollow shaft 15 serves as a supply line for a pressurized fluid such as water from the water flushing system of the toilet which may flow through a bore in the corrugated plate 19 into the bellows 16. When the toilet cover 1 is open, i.e. is rotated approx. 90° in a clockwise direction with respect to FIG. 7 and the pressurized fluid flows into the bellows 16 in this position, the housing plate 18 will be moved by the fluid pressure in a counterclockwise (anti-clockwise) direction, whereby the housing 17 with the toilet cover 1 attached thereto will be pivoted into its closed position (FIG. 7). The toilet cover may be pivoted back into the open position by means of a return spring (not shown) which is designed as a torsion spring and which is disposed advantageously in the area of the hollow shaft 20.

It may also be advantageous provided that the gap between the corrugated plate 19 and the inner surface of the housing 17 as well as the gap between the housing plate 18 and the surface of the hollow shaft 20 are sealed slidingly by means of a seal (not shown). In this case, the housing plate 18 operates for practical purposes like a piston in a rotary cylinder when the pressurized fluid supplied via the supply line 15 flows into the housing 17 and imparts a rotary motion to the housing plate 18.

What is claimed is:

1. A device for cleaning a waterflushed toilet bowl and toilet seat comprising:

lid means positionally mountable in sealing engagement with the outer periphery of a toilet bowl for enclosing the toilet seat;

drying means secured to the underside of said lid means and stationed above the bowl for dispersment of a drying agent;

guide means disposed below said drying means for guiding the drying agent in cooperation with said lid means to the surface of the toilet seat for drying thereof; and spray means secured to said lid means and disposed below said guide means for dispersment of a cleaning fluid, said spray means operable for spraying the toilet bowl and cooperable with said guide means for guiding the cleaning fluid onto the toilet seat for cleansing thereof;

2. A device according to claim 1 and further including draining means disposed in the area of said sealing engagement of said lid means with the toilet bowl, said draining means draining any residue cleaning fluid tending to collect in said area.

3. A device according to claim 2 wherein said draining means includes passageways integrally formed in the toilet bowl for carrying the residue cleaning fluid into the bowl.

4. A device for cleaning a waterflushed toilet bowl and toilet seat comprising:

lid means positionally mountable in sealing engagement with a toilet seat of a toilet bowl;

drying means secured to the underside of said lid means and stationed above the bowl for dispersment of a drying agent;

guide means disposed below said drying means for guiding the drying agent in cooperation with said lid means to the surface of the toilet seat for drying thereof; and spray means secured to said lid means and disposed below said guide means for dispersment of a cleaning fluid, said spray means operable for spraying the toilet bowl and cooperable with said guide means for guiding the cleaning fluid onto the toilet seat for cleansing thereof;

5. The device according to claim 4 and further including a toilet seat, said toilet seat shaped for providing drainage of the cleaning fluid into the bowl.

6. A device for cleaning a waterflushed toilet bowl having its upper rim designable into an integrally formed toilet seat comprising:

lid means positionally mountable in sealing engagement with the upper rim of a toilet bowl;

drying means secured to the underside of said lid means and stationed above the bowl for dispersment of a drying agent;

guide means disposed below said drying means for guiding the drying agent in cooperation with said lid means to the outer periphery of the rim and thereacross for a drying thereof;

spray means secured to said lid means and disposed below said guide means for dispersment of a cleaning fluid, said spray means operable for spraying the toilet bowl and cooperable with said guide means for guiding cleaning fluid onto the rim of the bowl for cleansing thereof;

7. A device according to claim 6 wherein said guide means is a substantially horizontal plate.

8. A device according to claim 7 wherein said guide means extends into the area above the rim.

9. A device according to claim 6 wherein said spray means includes a rotatable spray head operable by pressure of the cleaning fluid.

10. A device according to claim 9 wherein said spray head includes a turbine rotor means positioned for rotational movement about a vertical axis when said lid means is positioned onto the bowl; tapering inlet means radially tapering around the periphery of said rotor means, for supplying the cleaning fluid to said rotor means under pressure; and nozzle means depending from said rotor means and rotatable therewith, said nozzle means having at least one discharge opening for spraying the cleaning fluid therefrom.

11. A device according to claim 10 wherein said nozzle means comprises a chamber substantially conical in shape and having said discharge opening along a generatrix thereof.

12. A device according to claim 11 wherein said chamber has its axis along the axis of rotation of said rotor means and having a slot-shaped discharge opening positioned in a plane disposed perpendicular with respect to said axis of rotation.

13. A device according to claim 9 wherein said drying means includes a ventilator, said ventilator comprising a plurality of blades and a shaft carrying said blades for rotational movement thereof to ventilate, and wherein said rotatable spray head is coupled to said shaft.

14. A device according to claim 13 and further including a motor means, said motor means operable for driving said shaft.

15. A device according to claim 13 wherein said spray means and said ventilator drivable together by the pressure of the cleaning fluid.

16. A device according to claim 6 wherein said spray means includes a shower spray means having a plurality of discharge openings for directing of the cleaning fluid.

17. A device according to claim 16 wherein said spray means includes a rotatable annular receptacle means operable by the pressure of the cleaning fluid.

18. A device according to claim 13 and further including a heating means cooperable with said ventilator for heating the air traveling therethrough.

19. A device according to claim 6 wherein said drying means includes a ventilator rotatably mounted for operability, and said spray means includes a nozzle means rotatably mounted for operability, and said guide means is rotatably mounted together with said ventilator and said spray means, said guide means having blades in the area of the rim and said spray means further including means for providing cleaning fluid to the blades for cleansing of the rim.

20. A device according to claim 6 wherein said lid means is pivotably mountable onto the toilet bowl.

21. A device according to claim 20 and further including:

a substantially cylindrical housing formed on said lid means;

a pivotal bearing shaft for securement to the bowl and cooperable with said cylindrical housing for pivotably mounting said lid means to the bowl;

bellows means disposed within said cylindrical housing for receiving pressurized fluid to pivot said lid means on said bearing shaft.

22. A device according to claim 21 and further including spring means cooperable with said cylindrical housing and said pivotal bearing shaft for pivoting said lid means in cooperation with said bellows means.

* * * * *